US012736272B2

(12) United States Patent
Berioli et al.

(10) Patent No.: US 12,736,272 B2
(45) Date of Patent: Sep. 15, 2026

(54) EVAPORATION TRAY FOR REFRIGERATOR CONDENSATION WATER

(71) Applicant: I.R.C.A. S.P.A. INDUSTRIA RESISTENZE CORAZZATE E AFFINI, Vittorio Veneto (IT)

(72) Inventors: Mauro Berioli, Vittorio Veneto (IT); Gianluca Cestaro, Oriago di Mira (IT); Antonio De Moliner, Oderzo (IT); Federico Zoppas, Treviso (IT)

(73) Assignee: I.R.C.A. S.P.A. INDUSTRIA RESISTENZE CORAZZATE E AFFINI, Vittorio Veneto (IT)

( * ) Notice: Subject to any disclaimer, the term of this patent is extended or adjusted under 35 U.S.C. 154(b) by 256 days.

(21) Appl. No.: 18/724,129

(22) PCT Filed: Dec. 21, 2022

(86) PCT No.: PCT/IB2022/062609
§ 371 (c)(1),
(2) Date: Jun. 25, 2024

(87) PCT Pub. No.: WO2023/126781
PCT Pub. Date: Jul. 6, 2023

(65) Prior Publication Data

US 2025/0067499 A1 Feb. 27, 2025

(30) Foreign Application Priority Data

Dec. 28, 2021 (IT) ..... 102021000032828

(51) Int. Cl.
*F25D 21/14* (2006.01)
*F25D 21/00* (2006.01)

(52) U.S. Cl.
CPC ..... *F25D 21/14* (2013.01); *F25D 21/006* (2013.01); *F25D 2321/1413* (2013.01); *F25D 2321/144* (2013.01)

(58) Field of Classification Search
CPC ..... F25D 21/14; F25D 21/006; F25D 2321/1413; F25D 2321/144; F24F 13/22; F24F 13/222
See application file for complete search history.

(56) References Cited

FOREIGN PATENT DOCUMENTS

DE 102011075002 A1 10/2012
DE 102011084718 A1 4/2013
(Continued)

OTHER PUBLICATIONS

International Search Report and Written Opinion for PCT/IB2022/062609, mailing date Mar. 23, 2023.
(Continued)

*Primary Examiner* — Joseph F Trpisovsky
(74) *Attorney, Agent, or Firm* — Troutman Pepper Locke LLP

(57) ABSTRACT

An evaporation tray (1) for condensation water, in particular for a refrigerator, comprising a cartridge (2), containing one or more PTC-effect electric resistors (8), capable of evaporating condensation water (4) in the evaporation tray (1) by heating the cartridge (2), the cartridge (2) being fixed in the evaporation tray (1) so as to be at least partially coverable by condensation water (4) during the operation thereof, a control circuit (5) adapted to control the electric current power supply of the one or more PTC-effect electric resistors (8) comprising a switch (51) for the power supply of the one or more PTC-effect electric resistors (8), the control circuit (5) being programmed to open
(Continued)

the switch (51) according to the attainment of a predetermined water level in the evaporation tray (1).

14 Claims, 3 Drawing Sheets

(56) References Cited

FOREIGN PATENT DOCUMENTS

| | | | | | |
|---|---|---|---|---|---|
| JP | 147074 | A | | 5/2001 | |
| JP | 074090 | A | | 3/2005 | |
| KR | 20090029105 | A | * | 3/2009 | ..... F24F 11/89 |
| WO | WO-9533168 | A1 | * | 12/1995 | ..... F25D 21/14 |

OTHER PUBLICATIONS

International Preliminary Report on Patentability for PCT/IB2022/062609, mailing date Apr. 11, 2024.

* cited by examiner

EVAPORATION TRAY FOR REFRIGERATOR CONDENSATION WATER

CROSS-REFERENCE TO RELATED APPLICATION

This application is a national stage application under 35 U.S.C. § 371 of PCT Application No. PCT/IB2022/062609, filed Dec. 21, 2022, which claims the priority benefit of Italian Patent Application No. 102021000032828, filed Dec. 28, 2021, each of which is incorporated by reference herein in its entirety.

FIELD OF THE INVENTION

The present invention relates, in particular, to a heating device which supplies heat to evaporate the condensation water produced, for example, in refrigerators, and to a method for controlling the heating device.

BACKGROUND ART

In refrigeration systems, during operation, condensation water is produced, which is usually collected in a container, e.g., in a tray, which allows the water collected to evaporate and avoids the need for a connection to an external drainage system. It is also beneficial to accelerate the evaporation, in particular, when the refrigeration system is large in size and the amount of condensation produced is remarkable. For this purpose, an electric heating resistor is provided, which is immersed in water and, by heating it, accelerates the evaporation thereof. An evaporation tray provided with a heating resistor is often also provided with a switch which cuts off the current and ends the heating function when the water in the tray has completely evaporated or has decreased below a predetermined level, so as to reduce electricity consumption when the heat produced by the resistor becomes useless for heating the water.

Evaporation trays of the known type include electric current cut-off systems which are activated by a float which rises and falls according to the rising and falling of the water level and cuts off the electric power supply when the float falls and the water leaves the heating resistor uncovered. On the other hand, when the water level in the tray rises up to cover the resistor, the float also rises in level and closes the current circuit, and the heating resistor resumes producing heat which favors the evaporation of the water.

The use of a float creates reliability issues since it may become blocked due to the presence of scale or due to other reasons and no longer respond accurately. Other switches may be used, which, however, would be more expensive.

Therefore, the need is felt to have an evaporation tray with a current cut-off system which is reliable while keeping production costs low.

SUMMARY OF THE INVENTION

It is an object of the present invention to provide a condensation water evaporation tray for a refrigeration system which is reliable and has a low production cost.

The present invention achieves at least this object by means of an evaporation tray for condensation water, in particular, for a refrigerator which comprises a cartridge containing one or more PTC-effect electric resistors capable of evaporating the water in the evaporation tray by heating the cartridge, and arranged, in particular fixed, in the evaporation tray, so as to be at least partially covered by the condensation water during the operation thereof,

- a control circuit for controlling the electric current power supply of the one or more PTC-effect electric resistors, comprising a switch for the power supply current of the one or more PTC-effect electric resistors. The control circuit is preferably programmed to open, in particular to open or close, the switch preferably according to the reaching of a predetermined water level in the evaporation tray.

The evaporation tray may preferably, but not exclusively, have one or more of the following features:

- said control circuit is configured so as to measure the electric power absorbed by the cartridge; and/or
- said control circuit is configured so as to control the electric current supply of the one or more PTC-effect electric resistors according to the electric power absorbed by the cartridge; and/or
- said control circuit is configured to open the switch if the control circuit detects a decreased electric power absorption of the cartridge, and said control circuit is configured to close the switch if the control circuit detects an increased electric power absorption of the cartridge; and/or
- said control circuit is configured to open the switch if the control circuit detects that the electric power absorbed by the cartridge is lower than a predetermined electric power threshold level, and said control circuit is configured to close or keep the switch closed if the control circuit detects that the electric power absorbed by the cartridge is greater than said predetermined electric power threshold level; and/or
- the control circuit comprises a current meter adapted to measure the electric power absorbed by the cartridge; and/or
- the control circuit is configured so as to measure the electric power absorbed by the cartridge at pre-programmed (or pre-established) time intervals, preferably with a duration from 30 to 60 minutes; in particular wherein the control circuit is configured so that, if the switch is open, the switch is closed at pre-programmed (or pre-established) time intervals to measure the electric power absorbed by the cartridge.

The invention also relates to a refrigerator according to claim 12.

The invention also relates to a method, according to claim 13, for controlling a cartridge in which condensed water, in particular produced by a refrigerator, is collected in the tray, wherein

- if the control circuit detects an increased absorption of electric power in the cartridge or if the control circuit detects that the power absorbed by the cartridge is greater than a predetermined electric power threshold level, the control circuit commands the closure of said switch, (or keeps said switch closed), allowing the electric current power supply of the cartridge; and
- if the control circuit detects a decreased electric power absorption of the cartridge or if the control circuit detects that the power absorbed by the cartridge is lower than said predetermined electric power threshold level, the control circuit commands the opening of the switch, cutting off the electric current power supply of the cartridge.

In particular, preferably, the method provides that:

- if, or when, the level of the condensation water in the tray reaches a height greater than or equal to the height of the horizontal plane tangent to the lowest surface (or surface portion) of the cartridge, the control circuit detects the increased absorption of electric power in the cartridge and commands the closure of said switch allowing the electric power supply of the cartridge;

if, or when, the level of the water in the evaporation tray falls below the height of the horizontal plane tangent to the lowest surface (or surface portion) of the cartridge, the control circuit detects the decreased electric power absorption of the cartridge and commands the opening of the switch, cutting off the electric current power supply of the cartridge.

In particular, said lowest surface or surface portion of the cartridge is the surface or surface portion closest to the bottom of the tray.

Advantageously, a pan or tray according to the invention allows to avoid the use of mobile mechanical elements, in particular the use of a float which continuously moves alternately from above downwards and vice versa is avoided, and the risk that for some reason it remains blocked in any position and no longer performs the cut-off function, leaving the resistor always on or always off, is avoided. A tray according to the invention, on the other hand, does not have moving mechanical elements and increases the reliability of the control of the resistor, while ensuring minimum energy consumption.

Furthermore, advantageously, a tray according to the invention does not require the use of temperature sensors or other temperature detection means to control the activation and deactivation of the power supply of the cartridge.

The use of the PTC effect is essential since it allows to deduce the presence of water (in particular, to deduce whether the cartridge is touched by the water in the tray or not) by detecting the value of the electric power absorbed by the one or more PTC resistors of the cartridge (in particular, by detecting the current value), while with an ohmic resistor of the prior art it would not be possible to achieve the operating mode of the invention.

Advantageously, a cartridge containing one or more PTC resistors allows to detect whether the cartridge is wetted or not (or touched or not, or immersed or not) by the water contained in the tray, according to the electric power absorbed by the cartridge.

In fact, when using a cartridge containing one or more PTC resistors, there is a substantial difference in power absorbed by the one or more PTC resistors of the cartridge between a state in which the cartridge is wetted by the water in the tray and a state in which the cartridge is dry, i.e., it is not touched or not wetted by the water in the tray. In other words, when using one or more PTC resistors, there is a substantial difference in electric power absorbed by the one or more resistors of the cartridge between a state in which the cartridge is not immersed in the water in the tray and a state in which the cartridge is immersed in the water in the tray. The absorbed power values may therefore be indicative of the level of liquid in the tray.

Advantageously, the same component, i.e., the same cartridge, may perform the heating function to evaporate the water, and the cartridge itself also serves to detect whether the cartridge is touched (or wetted) or if it is not touched by the water in the tray. In particular, by means of the cartridge itself, it is possible to deduce whether the water in the tray is above or below a predetermined level. In particular, said predetermined level is preferably equal to the horizontal plane tangent to the lowest surface, or surface portion, of the cartridge.

Advantageously, a tray provided with a cartridge containing one or more PTC-effect electric resistors arranged inside the tray allows to control the heating of the cartridge in a reliable and economical manner.

The dependent claims describe preferred embodiments of the invention, forming an integral part of the present description.

BRIEF DESCRIPTION OF THE FIGURES

Further features and advantages of the invention will become more apparent in light of the detailed description of preferred, but not exclusive, embodiments of an evaporation tray for condensation water of a refrigeration machine, disclosed by way of explanation and not by way of limitation, with the aid of the enclosed drawings, in which.

The same reference numerals and letters in the drawings identify the same elements or components.

DETAILED DESCRIPTION OF EXAMPLE EMBODIMENTS OF THE INVENTION

Figure 1:
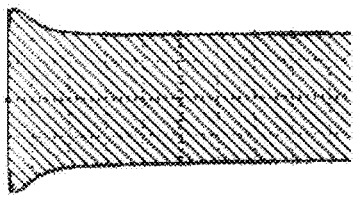
FIG. 1 shows a graph with the trend over time of the power absorption of the PTC resistor when it is completely immersed in water.

With reference to the Figures, exemplary embodiments of a pan or tray, or evaporation pan or evaporation tray, are described, globally indicated with 1. In all embodiments, the evaporation pan 1 for condensed water, in particular for a refrigerator, comprises a cartridge 2, or PTC cartridge 2, containing one or more PTC-effect electric resistors 8, capable of evaporating condensation water 4 in the evaporation tray 1 by heating the cartridge 2, the cartridge 2 being fixed inside the evaporation tray 1 so as to be at least partially covered by condensation water 4 during the operation thereof;

a control circuit 5 adapted to control the electric current power supply of the one or more PTC-effect electric resistors 8 comprising a switch 51 for the power supply of the one or more electric resistors 8, or more generally for the power supply of the cartridge 2. The control circuit 5 is preferably programmed to open the switch 51 preferably according to the reaching of a predetermined level of the condensation water 4 in the evaporation tray 1.

In particular, the cartridge 2 is arranged inside the tray 1, in particular, so that it can be wetted by the water 4 which may be present in the tray 1.

The aforesaid predetermined level of the condensation water 4 in the evaporation tray 1, preferably, corresponds to the level, preferably the minimum level, in which the cartridge 2 is touched (or wetted) by the water 4 present in the tray 1.

In particular, said predetermined level is preferably equal to the horizontal plane P (represented in FIGS. 3 and 4) tangent to the lowest surface, or surface portion, of the cartridge 2, said surface or surface portion being, in particular, proximal to the bottom 12 of the tray 1.

In this description, when mentioning a PTC cartridge, reference is made to a heating element or heating device, referred to, for simplification, as a cartridge, containing one or more PTC-effect electric heating resistors 8 therein, also referred to as "PTC pads" 8. As it is known to those skilled in the art, "PTC" is the acronym for Positive Temperature Coefficient. In particular, said one or more PTC-effect heating resistors 8, or PTC resistors, generate heat when they are electrically powered. Preferably, the cartridge 2 comprises one or more metal bodies 9, for example made of aluminum, adapted to conduct current to said one or more PTC-effect heating resistors 8.

Figure 7A:
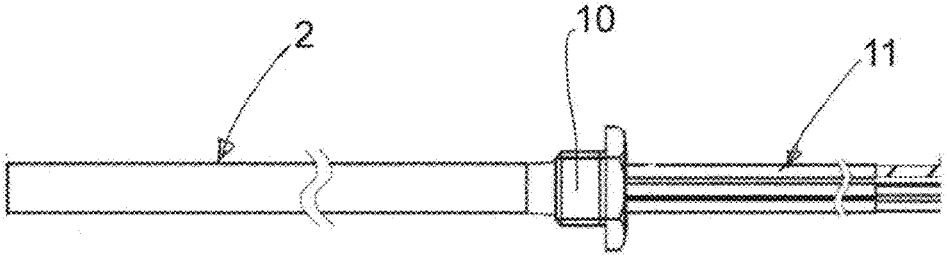
FIG. 7A shows a side view of an embodiment of a component of the tray of the invention.
Figure 7B:
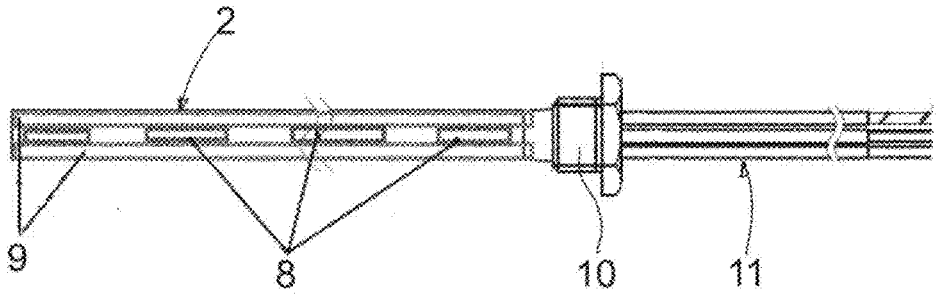
FIG. 7B shows a partial axial section of the component of FIG. 7A.

An example of cartridge 2 provided with PTC pads 8 is shown in greater detail in FIGS. 7A and 7B. In particular, the current is transmitted to the PTC pads 8 by means of two bodies 9, for example two aluminum profiles 9, preferably having a semicircular cross-section. Other forms of cartridges equivalent to this one disclosed are possible without departing from the scope of the invention. Although the use of PTC pads is preferred for the advantages thereof, it does not exclude other types and forms of PTC-effect heating elements.

A feature of PTC-effect resistors or pads 8 is that of increasing the resistance coefficient as the temperature of the resistor itself increases.

The cartridge 2 is preferably fixed horizontally to a wall of the tray 1, e.g., by means of a locking ring 10.

The cartridge 2 preferably has a substantially cylindrical shape. The cartridge 2 is preferably provided with a junction which is threaded at the base.

Figure 3:
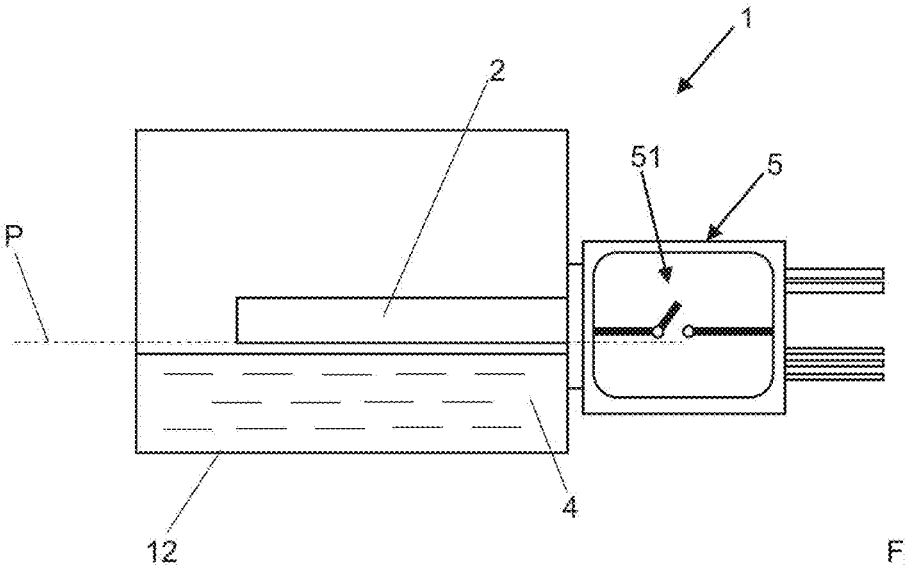
FIG. 3 shows a diagram of a tray according to the invention.

FIG. 3 shows the cartridge 2 in a position out of the condensation water 4 and arranged at a height or distance from the bottom 12 of the tray 1 such that the plane on which the lower end or lower portion thereof lies (proximal to the bottom 12) determines the minimum water level when the evaporation function is activated. Preferably, such height is set very low, preferably a few millimeters, to maximize the heating capacity thereof even with a small amount of water.

A control circuit 5 for controlling the cartridge 2 is provided which receives the electric power absorption signal by the cartridge 2 itself, which indicates whether the latter is totally or partially immersed in the water, or if it is completely uncovered by the water and only surrounded by air. When the water falls, in particular, down to the minimum design level, due to the progress of the evaporation, the cartridge 2 changes the power absorption level thereof, which is detected by the control circuit 5, which, in turn, activates a switch 51 which cuts off the power supply of the cartridge 2 (in FIG. 3 the switch 51 is open). When the level of the condensation water 4 in the tray 1 rises and covers part of the body of the cartridge 2, the latter has a higher current power absorption level, in particular corresponding to the design value, and this is detected by the control circuit 5 which operates the switch 51 thus supplying current to the cartridge 2 which heats the water and accelerates the function of evaporating the water 4. The control circuit 5 preferably comprises an electronic control unit, not shown.

FIG. 1 shows a typical graph of the qualitative trend of the electric power which is absorbed by a PTC cartridge when it is powered with current and is immersed in water and therefore has a strong power absorption.

Figure 2:
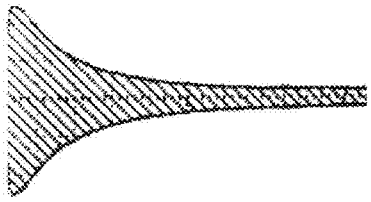
FIG. 2 shows a graph with the trend over time of the power absorption of a PTC resistor when it is completely out of the water.

FIG. 2 shows the graph of the electric power absorption trend of the cartridge 2 itself when it is in air, for example after the water in which the cartridge 2 was immersed has dried up and shows the very rapid reduction of electric power absorption which occurs immediately after an initial power absorption peak has occurred, due to the increased resistance value of the one or more PTC resistors 8 upon the temperature thereof increases.

It is provided that the control circuit 5 controls, in particular it measures, the electric power absorbed by the PTC cartridge 2 at pre-programmed time intervals, for example with a duration from 30 to 60 minutes.

In particular, it is provided that the control circuit 5 controls, in particular it measures, the electric power absorbed by the PTC cartridge 2, in particular powering the latter, in particular if it is not already powered, at regular time intervals, e.g., approximately every 30 or 60 minutes, or longer or shorter time intervals. Said time intervals are chosen, in particular, on the basis of the evaporation capacity of the cartridge 2 itself and the amount of water which the tray 1 contains or which is poured into the tray 1. The control circuit 5 commands the switching on of the cartridge 2, preferably when the water level has begun to touch cartridge 2, and this is detected upon the higher power absorption; furthermore, the control circuit 5 commands the switching off of the cartridge 2 when the latter remains completely uncovered by the water, and, in particular, is only working in air.

The control circuit 5 preferably comprises a current meter for recognizing the different amount of power absorption of the one or more PTC resistors 8 of the cartridge 2. In particular, it is sufficient to recognize the exceeding of a threshold upwards or downwards to detect the presence or absence of water around the cartridge 2, and it is not necessary to detect the exact level of water for the system to operate correctly.

The electric current power supply of the cartridge 2 is provided in a manner known to the person skilled in the art by means of cables 11 and is not described in detail herein.

A preferred operating method of a tray 1 according to the invention is now described. Condensed water, especially that produced by a refrigerator, is collected in the tray 1.

If, or when, the water level 4 in the tray 1 reaches a height which touches the cartridge 2, the control circuit 5 detects the increased absorption of electric power in the PTC cartridge 2 and commands the closing of the switch 51, thus allowing the electric current supply of the cartridge 2 itself.

If, or when, the water level 4 in the tray 1 falls below the height at which it touches the cartridge 2 due to the evaporation, the control circuit 5 detects the decreased electric power absorption of the cartridge 2 and commands the opening of the switch 51, thus cutting off the electric current power supply of the cartridge 2.

In particular, the control circuit 5 periodically detects the power absorbed by the cartridge 2 at pre-programmed time intervals, e.g., every 30 or 60 minutes, but other shorter or longer intervals may be chosen, leaving the cartridge 2 powered when it is detected that the water level 4 in the tray 1 exceeds the minimum level, i.e., when the cartridge 2 is at least partially touched by the condensation water in the tray 1.

Figure 4:
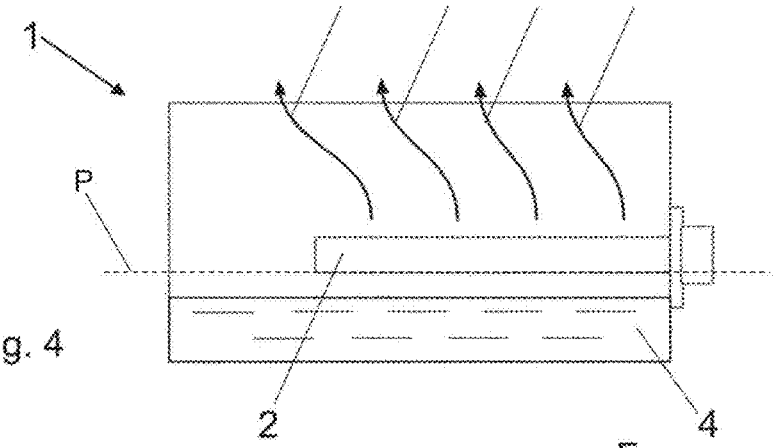
FIG. 4 shows a diagram of the operation of the tray of FIG. 3.

When the water level 4 is below a determined level, the current-powered cartridge 2 dissipates heat into air, since it is no longer surrounded by water which leads to a waste of energy, as shown by the diagram in FIG. 4, where the arrows F indicate in a very diagrammatic manner the dispersion of heat into air even when the water does not touch the cartridge 2, and, although such heat dispersion is very low, in particular cases, it is also advantageous to limit this lost. This may occur, for example, if the water level has dropped below the cartridge 2 before the control circuit has measured the electric power absorbed by the cartridge 2.

Preferably, in all embodiments, the cartridge 2 provides that the heating pads 8 operate so as to reach a condition of thermal equilibrium around a given temperature, preferably around 180° C. This means that once the cartridge 2 is working in air, the absorbed current is reduced according to the thermal energy transmitted to the environment and not to the water, bringing the cartridge 2 to a temperature preferably close to 180° C. when fully operational.

As an example, a conventional PTC cartridge 2 with a nominal power of 250 W, when in water, once dry, continues to absorb approximately 30 to 40 W of power. This is thermal energy dissipated in the air.

Figure 5:
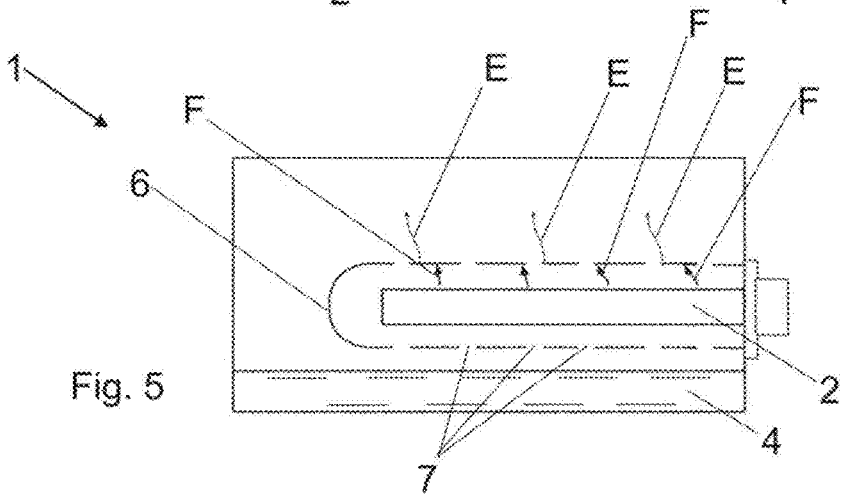
FIG. 5 shows a variant of the tray of the invention in a particular operating step.
Figure 6:
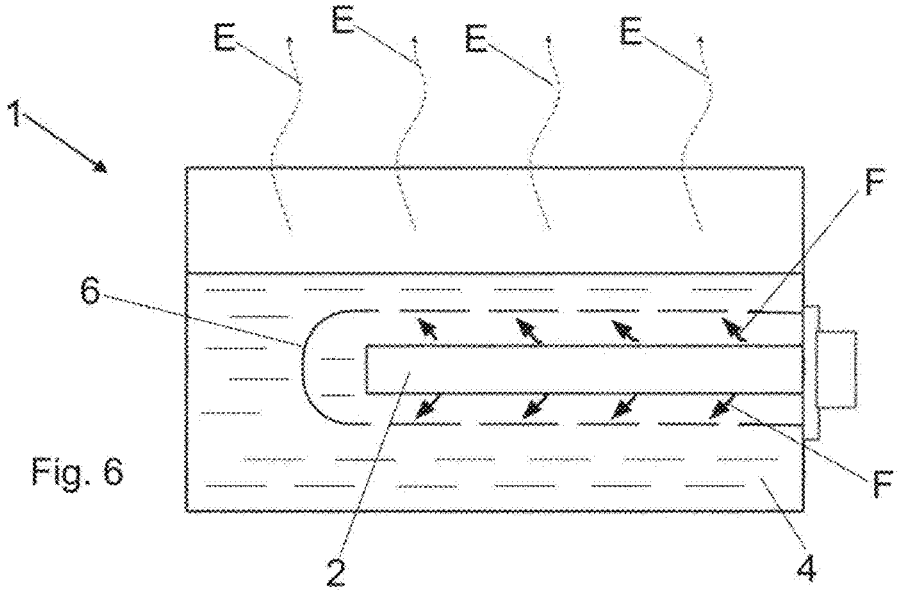
FIG. 6 shows the variant of the tray of the invention of FIG. 5 in another operating step.

Therefore, in particular in such cases, to reduce the consumption of electricity, the following embodiment of the invention described herein is implemented, with particular reference to FIG. 5 and FIG. 6. The cartridge 2 is enclosed in a thermally insulating structure or shield 6 or thermally insulating element. The thermally insulating structure 6 may, for example, be a pipe made of a low conductivity material, e.g., made of stainless steel, or a cover made of a sheath of glass wool or ceramic wool or another thermally insulating material.

In particular, during operation, the cartridge 2 always reaches the fully operational condition thereof, which is determined by the equilibrium temperature of the PTC heating pads 8 used therein. The thermal energy radiated towards the environment will be lower since the thermal radiation and the thermal convection, diagrammatically indicated by the arrows F, are hindered by the insulating structure 6 which wraps or surrounds or encloses the cartridge 2. Consequently, the electricity absorbed, necessary to maintain the equilibrium condition, is considerably reduced. From laboratory tests, an electrical absorption of about 7 to 8 W is measured when fully operational.

The result is therefore an important energy saving during the operating step when the cartridge 2 is on in the air and does not transmit heat to the water, but disperses a small amount of energy to the environment, as diagrammatically indicated by the arrows E in FIG. 5.

In the immersed operating condition, when the cartridge 2, with the thermally insulating structure 6 which wraps or surrounds or encloses it, works to evaporate the condensation water, as shown in FIG. 6 (where the arrows very diagrammatically indicate evaporation), the cartridge 2 absorbs electricity from the electrical network to which it is connected and transforms it into heat transmitted to the water, as it is well known, and the arrows F very diagrammatically indicate such heat transmission.

Water 4 heats up and evaporates quickly. The thermally insulating structure 6 arranged about the PTC cartridge 2 is, in particular, provided with holes 7, in particular small holes, in the case of an insulation made with a metal pipe, so that the water still wets the cartridge 2 and is consequently efficiently heated. In the case of an insulation of the glass wool or ceramic wool type, or of a similar insulating material, it is the porous structure of the material itself which ensures that the water may, in any case, wet the surface of the cartridge 2 and that it is consequently efficiently heated.

Laboratory tests show that, as a first approximation, the water evaporation rate remains substantially comparable to the embodiment of the invention without a thermally insulating structure 6. A reduction in the power used during the evaporation step was also noted, and laboratory tests have shown a reduction of about 25% of the electric power used. The use of the thermally insulating structure 6, advantageously, allows to increase the difference between the electric power absorbed when the cartridge is at least partially wetted by the water in the tray, and when the cartridge 2 is not wetted by the water in the tray. It should be noted that the cartridge 2 may be optionally surrounded by a thermally insulating structure or shield 6, in particular as just described, in all embodiments of the invention. The thermally insulating structure 6, preferably, in all embodiments, is provided with holes or pores for the passage of water, such that the cartridge 2 may, in any case, be wetted by the water 4.

The elements and features disclosed in the various preferred embodiments may be combined without however departing from the scope of protection of the present application.

The invention claimed is:

1. An evaporation tray for condensation water, in particular for a refrigerator, comprising a cartridge, containing one or more PTC-effect electric resistors, capable of evaporating condensation water in the evaporation tray by heating the cartridge, the cartridge being fixed in the evaporation tray so as to be at least partially coverable by condensation water during the operation thereof;

a control circuit adapted to control the electric current power supply of the one or more PTC-effect electric resistors comprising a switch for the power supply of the one or more PTC-effect electric resistors, the control circuit being programmed to open the switch according to the attainment of a predetermined water level in the evaporation tray;

wherein the cartridge is wrapped or surrounded by a thermally insulating shield.

2. The evaporation tray according to claim 1, wherein said control circuit is configured so as to control the electric current power supply of the one or more PTC-effect electric resistors according to the electric power absorbed by the cartridge.

3. The evaporation tray according to claim 1, wherein said control circuit is configured to open the switch if the control circuit detects a decreased electric power absorption of the cartridge;

and wherein said control circuit is configured to close the switch if the control circuit detects an increased electric power absorption of the cartridge.

4. The evaporation tray according to claim 1, wherein said control circuit is configured to open the switch if the control circuit detects that the electric power absorbed by the cartridge is lower than a predetermined electric power threshold level;

and wherein said control circuit is configured to close or keep the switch closed if the control circuit detects that the electric power absorbed by the cartridge is greater than said predetermined electric power threshold level.

5. The evaporation tray according to claim 1, wherein said control circuit is configured so as to measure the electric power absorbed by the cartridge; and/or wherein the control circuit comprises an electric current meter adapted to measure the electric power absorbed by the cartridge.

6. The evaporation tray according to claim 1, wherein the control circuit is configured so as to measure the electric power absorbed by the cartridge at pre-programmed time intervals, preferably with a duration from 30 to 60 minutes; in particular, wherein the control circuit is configured so that, if the switch is open, the switch is closed at pre-programmed time intervals to measure the electric power absorbed by the cartridge.

7. The evaporation tray according to claim 1, wherein the cartridge is arranged in a horizontal position and is arranged so as to be completely immersed in water when the evaporation tray is full.

8. The evaporation tray according to claim 1, wherein the predetermined water level is equal to the horizontal plane tangent to the lowest surface, or surface portion, of the cartridge.

9. The evaporation tray according to claim 1, wherein the thermally insulating shield is a pipe made of stainless steel, or a coating made of glass wool or a coating made of ceramic wool.

10. The evaporation tray according to claim 1, wherein said thermally insulating shield is provided with a plurality of holes or pores adapted to allow the passage of water, whereby the cartridge can be at least partially covered by condensation water in the evaporation tray during the operation thereof.

11. A refrigerator provided with an evaporation tray according to claim 1.

12. A method for controlling the cartridge of the evaporation tray according to claim 1, wherein condensation water, produced in particular by a refrigerator, is collected in the evaporation tray, wherein if the control circuit detects an increased absorption of electric power in the cartridge or if the control circuit detects that the power absorbed by the cartridge is greater than a predetermined electric power threshold level, the control circuit commands the closure of said switch, or keeps said switch closed, allowing the electric current power supply of the cartridge; and if the control circuit detects a decreased electric power absorption of the cartridge or if the control circuit detects that the power absorbed by the cartridge is lower than said predetermined electric power threshold level, the control circuit commands the opening of the switch, cutting off the electric current power supply of the cartridge.

13. The control method according to claim 12, wherein if, or when, the level of the condensation water in the evaporation tray reaches a height greater than or equal to the height of the horizontal plane tangent to the lowest surface of the cartridge, the control circuit detects said increased absorption of electric power in the cartridge and commands the closure of said switch, or keeps said switch closed, allowing the electric current power supply of the cartridge, and if, or when, the level of the water in the evaporation tray falls below the height of the horizontal plane tangent to the lowest surface of the cartridge, the control circuit detects said decreased electric power absorption of the cartridge and commands the opening of the switch, cutting off the electric current power supply of the cartridge.

14. The control method according to claim 12, wherein the control circuit carries out a detection of the electric power absorbed by the cartridge carried out at pre-programmed time intervals, preferably with a duration from 30 to 60 min; in particular, wherein said detection of the electric power absorbed by the cartridge is carried out to detect whether or not the cartridge is touched by condensation water in the evaporation tray.

* * * * *